US007757747B2

(12) United States Patent
McIntosh

(10) Patent No.: US 7,757,747 B2
(45) Date of Patent: Jul. 20, 2010

(54) SUBMERGED ENTRY NOZZLE

(75) Inventor: James L. McIntosh, Mason, OH (US)

(73) Assignee: Nucor Corporation, Charlotte, NC (US)

( * ) Notice: Subject to any disclaimer, the term of this patent is extended or adjusted under 35 U.S.C. 154(b) by 31 days.

(21) Appl. No.: 11/763,666

(22) Filed: Jun. 15, 2007

(65) Prior Publication Data

US 2007/0241142 A1 Oct. 18, 2007

Related U.S. Application Data

(63) Continuation-in-part of application No. 11/380,546, filed on Apr. 27, 2006, now abandoned.

(60) Provisional application No. 60/594,665, filed on Apr. 27, 2005.

(51) Int. Cl.
*B22D 11/10* (2006.01)
*B22D 37/00* (2006.01)

(52) U.S. Cl. ..... 164/488; 164/437; 222/606

(58) Field of Classification Search ..... 164/437, 164/488; 222/606
See application file for complete search history.

(56) References Cited

U.S. PATENT DOCUMENTS 3,991,815 A * 11/1976 Fastner et al. ..... 164/437
4,487,251 A 12/1984 Cahoon et al.
4,730,754 A * 3/1988 Buhr et al. ..... 222/594
4,877,705 A 10/1989 Polidor
5,227,078 A 7/1993 Augustine, III
5,328,064 A * 7/1994 Nanba et al. ..... 222/607
5,370,370 A 12/1994 Benson
5,402,993 A 4/1995 Hofmann et al.
5,691,061 A 11/1997 Hanse et al.
5,716,538 A 2/1998 Poloni et al.
5,785,880 A 7/1998 Heaslip et al.
5,944,261 A 8/1999 Heaslip et al.
5,954,989 A 9/1999 Brook et al.
5,958,280 A 9/1999 Reichelt et al.
5,961,874 A 10/1999 Hasebe et al.
5,965,052 A * 10/1999 Sato et al. ..... 222/590
5,992,711 A 11/1999 Mochizuki et al.
6,016,941 A 1/2000 Damle (Continued)

FOREIGN PATENT DOCUMENTS

DE 4116723 6/1992

(Continued)

*Primary Examiner*—Kevin P Kerns
(74) *Attorney, Agent, or Firm*—Hahn, Loeser & Parks, LLP; Arland T. Stein

(57) ABSTRACT

A submerged entry nozzle (SEN) for use in a casting machine to conduct molten steel from a tundish to a mold may include a housing having an inlet capable of receiving an incoming flow of molten steel from the tundish, a distribution zone capable of delivering the molten steel to the mold; and a main body having a bore capable of conducting molten steel therethrough from the inlet to the distribution zone, the bore having sectional geometries capable of alternately compressing and decompressing the molten steel flow in flow path zones to alternately increase and decrease the steel flow velocity with at least two flow path zones capable of compressing the molten steel flow, and to deliver the molten steel from the distribution zone into the mold with flow turbulence inhibited.

39 Claims, 8 Drawing Sheets

U.S. PATENT DOCUMENTS

| | | | | |
|---|---|---|---|---|
| 6,027,051 | A | 2/2000 | Heaslip et al. | |
| 6,279,790 | B1 | 8/2001 | Nomura et al. | |
| 6,410,469 | B1 | 6/2002 | Hoover et al. | |
| 6,425,505 | B1 * | 7/2002 | Heaslip et al. | 222/594 |
| 6,464,154 | B1 * | 10/2002 | Heaslip et al. | 239/590.5 |
| 6,586,355 | B2 | 7/2003 | Hoover et al. | |
| 6,932,250 | B2 | 8/2005 | Bederka | |
| 2006/0243418 | A1 | 11/2006 | Hanna | |

FOREIGN PATENT DOCUMENTS

| | | | |
|---|---|---|---|
| JP | 57-7366 A | * | 1/1982 |
| JP | 57007366 | * | 1/1982 |

* cited by examiner

Section A-A

Section B-B

Section C-C

Section D-D

Section E-E

SUBMERGED ENTRY NOZZLE

RELATED APPLICATIONS

This application is a continuation in part of U.S. patent application Ser. No. 11/380,546, filed Apr. 27, 2006, and now abandoned, which claims priority from U.S. Provisional Patent Application Ser. No. 60/594,665, filed Apr. 27, 2005. The entire disclosures of application Ser. Nos. 11/380,546 and 60/594,665 are incorporated herein by reference.

BACKGROUND AND SUMMARY OF THE DISCLOSURE

This invention relates to the continuous casting of steel, and more particularly to submerged entry nozzles for use in delivering molten steel between the tundish and mold of a continuous casting machine.

Continuous casting is a steel making process that transforms liquid steel into semi-finished slabs, blooms, and billets that can be further processed into finished products. In its operation, liquid steel is supplied by ladle to a casting machine tundish and fed through a submerged entry nozzle, or "SEN," to a casting machine mold. The mold may be an open-ended box-like structure that provides the cast section with its desired shape. The mold may have four copper surfaced steel plates that function as the mold walls. The walls may be position adjusted inward and outward to change the width and thickness of the cast section, to produce slabs that are from, for example, about 50 to 230 millimeters (mm) thick and about 610 mm to 1520 mm wide. Water jackets in the copper lining provide primary cooling to the liquid steel that comes in contact with the mold walls, causing it to solidify and form a shell. Oscillating and vertical displacement of the mold prevents the solidifying shell from sticking to the walls.

The shell and its liquid core form a strand that is withdrawn from the mold by casting machine drive rollers at a rate that is substantially equal to the rate of flow of the liquid steel into the mold. This provides the continuous casting process with an operational steady state condition. As the strand exits the mold it is subjected to water spray or water mist secondary cooling which prevents reheating of the surface of the strand by the heat of the molten core, until the strand has traveled its "metallurgical length," at which point the core has solidified sufficiently that the strand can be cut to desired length on exit from the casting machine.

In the casting machine, the liquid metal is gravity fed from the tundish to the mold at a flow rate established by the bore size of the SEN. Different nozzle bore shapes and sizes may be selected depending on the section size and shape to be cast and the casting speed. The steel flow can be changed as necessary for the control of the casting operation. This may be done with a stopper rod that is fitted to the SEN inlet to restrict all or any part of the melt flow, or by a slide-gate that is drawn wholly or partially across the SEN inlet. The operation of the stopper rod or slide-gate may be performed manually by an operator, or automatically in response to a feedback signal from a level sensor in the mold.

The flow dynamics of the molten steel moving from the tundish to the mold can affect the quality of the continuous cast steel. A part of the casting process is the initial solidification of the liquid steel at the meniscus, which is the point at which the top of the solidifying steel shell meets the mold wall and the liquid steel of the mold bath. This is where the surface of the final cast product is created, and defects such as surface cracks can form if problems, such as too severe level fluctuations, occur in the liquid surface. To lessen this probability, oil or mold powder is added to the surface of the liquid steel in the mold. The mold powder produces a mold slag layer on the liquid surface which protects the liquid steel from the open air, provides it with thermal insulation, and also absorbs inclusions that are present in the liquid steel. Slag also flows into the gap between the mold wall and the shell to provide lubrication to the shell-to-copper interface.

Another factor related to the surface quality of the cast steel is the presence of turbulence and other transient phenomena in the flow of the molten steel from the SEN into the mold. The SEN delivers the molten steel through outlet ports in its distribution zone, which is submerged in the mold bath, below the mold slag line. Among the prior art nozzles that are commonly used are those in which the distribution zone has outlet ports positioned in opposite-side lateral passages at the bottom of the nozzle, discharging liquid steel in opposite lateral directions into the longer width dimension of the mold. Two outlet ports in each lateral passage provide the "double roll flow pattern" known in the art, in which each lateral passage discharge provides two flows. One moves upward through the mold bath and curls along the under surface of the meniscus and back toward the nozzle, and the other curls downward and also returns toward the nozzle.

The opposite side upward flows heat the meniscus to maintain its temperature at a level sufficient to melt the mold powder and provide proper lubrication to the casting. They also produce a standing wave profile at the liquid steel surface, which causes the mold powder slag layer to be thinner at the meniscus than around the nozzle body. It may be desired that the standing wave have a low amplitude, or at least a stable amplitude. Too high an amplitude standing wave may result from too high of a velocity of the upward flow. A varying amplitude, as may result from disrupted or intermittent flow velocities of the opposite side flows, can shear off droplets of mold slag or foreign particles trapped at the meniscus into the flow and entrain them in the liquid steel. The resulting inclusions can also generate surface defects and surface cracks in the finished steel.

Compact Strip Production (CSP), which is the casting of thin slabs which are about 50 mm to 100 mm (2 to 4 inches) thick, may use a SEN with a narrow substantially rectangular distribution zone. A funnel may also be fitted to the top of the mold to receive the SEN. With the CSP narrower dimensions, inclusion entrapment may result from nozzle-to-mold flow patterns having higher flow velocity. A SEN for use in CSP casting may be capable of maintaining stable steel flow velocities to satisfy CSP throughput but low enough to lessen entraining particles from the mold slag layer. The SEN may further provide flows that provide stable steel consistency, and that are substantially balanced at its lateral outlet ports.

The present disclosure is a submerged entry nozzle (SEN) with improved flow characteristics and production of slab cast steel. The submerged entry nozzle (SEN) is provided for use in a casting machine to deliver molten steel from a tundish to a casting mold comprising a housing having:

an inlet capable of receiving an incoming flow of molten steel from the tundish;

a distribution zone capable of delivering the molten steel into the casting mold; and a main body having a bore capable of conducting molten steel therethrough from said inlet to said distribution zone, said bore having sectional geometries capable of alternately compressing and decompressing the molten steel flow in flow path zones to alternately increase and decrease the steel flow velocity with at least two flow path zones capable of compressing the molten steel flow, and to deliver the molten steel from said distribution zone into the mold with flow turbulence inhibited.

The distribution zone may comprise first and second lateral passages having secondary flows formed by a flow divider, the lateral passages having baffles adjacent passage outlets dividing the molten steel secondary flows into four molten steel discharge flows delivering the molten steel to the mold in divergent directions.

The flow divider may have a leading edge having a radius of curvature for dividing the molten steel primary flow into the lateral passages with lessened flow turbulence, where the radius may be a maximum 5 mm radius. The flow divider may comprise a vertical section with opposite sides thereof forming surface contours directing molten steel flow through the lateral passages. Alternately, the flow divider may comprise a vertical section with substantially straight sides directing two molten steel discharge flows substantially vertically downward.

The housing of the SEN may transition along the sectional geometries of the main body from a substantially circular geometry to a substantially rectangular geometry having opposing side walls and opposing front and back walls at the distribution zone, the opposing front and back walls converging from the substantially circular geometry to the distribution zone.

The opposing side walls may transition from the substantially circular geometry to the substantially rectangular geometry at the distribution zone in an incremental manner. The opposing side walls may be altered incrementally along the bore to provide the sectional geometries, and the opposing front and back wall may converge in a continuous linear taper from the substantially circular geometry to the distribution zone. The sectional geometries may include an upper compression zone and a lower compression zone, the upper compression zone providing from three percent to ten percent compression of the molten steel flowing therethrough and the lower compression zone providing from three percent to ten percent compression of the molten steel flowing therethrough.

At least part of the main body of the SEN adjacent to a slag line when installed in the mold may comprise zirconia graphite.

Also disclosed is a method of continuously casting steel slabs comprising the steps of:

assembling a casting mold capable of continuous casting of melt slabs;

assembling a tundish above the casting mold capable of containing molten steel to be cast and having an outlet capable of discharging the molten steel for the tundish; and introducing molten steel into the casting mold from the outlet of the tundish through a submerged entry nozzle (SEN) comprising a housing having an inlet capable of receiving an incoming flow of molten steel from the tundish, a distribution zone capable of delivering the molten steel to the mold, and a main body having a bore capable of conducting molten steel therethrough from said inlet to said distribution zone, said bore having sectional geometries capable of alternately compressing and decompressing the molten steel flow in flow path zones to alternately increase and decrease the steel flow velocity with at least two flow path zones capable of compressing the molten steel flow, and to deliver the molten steel from said distribution zone into the mold with flow turbulence inhibited.

A continuous slab caster may comprise a casting mold capable of continuous casting of melt slabs; a tundish positioned above the casting mold capable of containing molten steel to be cast and having an outlet capable of discharging the molten steel from the tundish; and a submerged entry nozzle (SEN) capable of introducing molten steel into the casting mold from the outlet of the tundish, and comprising a housing having an inlet capable of receiving an incoming flow of molten steel from the tundish, a distribution zone capable of delivering the molten steel to the mold, and a main body having a bore capable of conducting molten steel therethrough from said inlet to said distribution zone, said bore having sectional geometries capable of alternately compressing and decompressing the molten steel flow in flow path zones to alternately increase and decrease the steel flow velocity with at least two flow path zones capable of compressing the molten steel flow, and to deliver the molten steel from said distribution zone into the mold with flow turbulence inhibited.

DETAILED DESCRIPTION OF THE DRAWINGS

Figure 1:
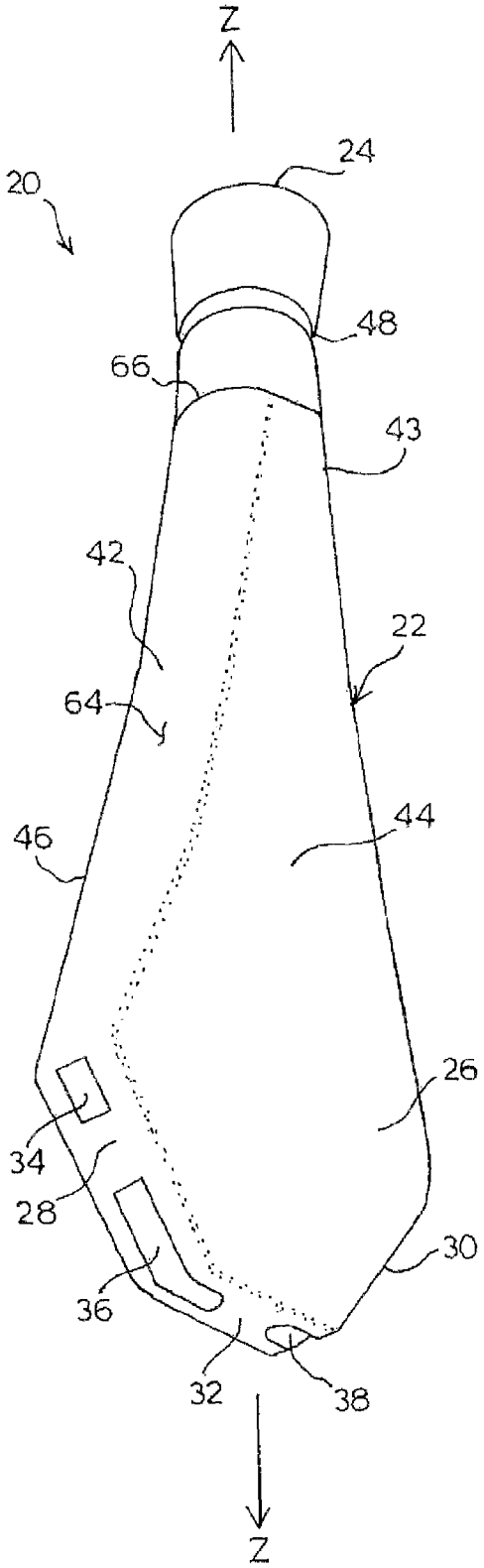
FIG. 1 is a perspective illustration of a submerged entry nozzle embodiment according to the present invention, shown vertically positioned along is longitudinal axis (Z) as in its operational placement between a casting machine tundish and mold.

FIG. 1 is a perspective illustration of a submerged entry nozzle, or "SEN," 20 shown vertically positioned along its longitudinal axis (Z) as in its operational placement for delivering molten metal between the casting machine tundish and mold. The SEN 20 has a main body 22, with an inlet 24 at one end for receiving liquid steel from a tundish (not shown), and a distribution zone 26 at the opposite end for delivering the liquid steel into the casting machine mold. The inlet 24 is adapted to mate with the output coupling of the tundish, which generally may be a substantially circular coupling. The liquid steel received at the inlet flows through a central bore in the main body 22 (described hereinafter with respect to FIGS. 3 through 10) to the distribution zone 26. The distribution zone 26 comprises first and second lateral passages 86, 88 having secondary flows formed by a flow divider 84. The lateral passages have baffles adjacent passage outlets dividing the molten steel secondary flows into four molten steel discharge flows delivering the molten steel to the mold in divergent directions. The distribution zone 26 channels the flow through the interior lateral passages (also described hereinafter with respect to FIGS. 3 through 10) to outlet ports disposed in opposite side segments, or facets 28, 30 of the SEN, and along a bottom portion 32 of the SEN. These include outlet ports 34, 36 in facet 28, with the outlet port 36 extending into the bottom portion 32, and outlet port 38 partially shown in the bottom 32 and extending to opposite side facet 30. Outlet port 39, also on facet 30 is not shown in this Figure.

Figure 2:
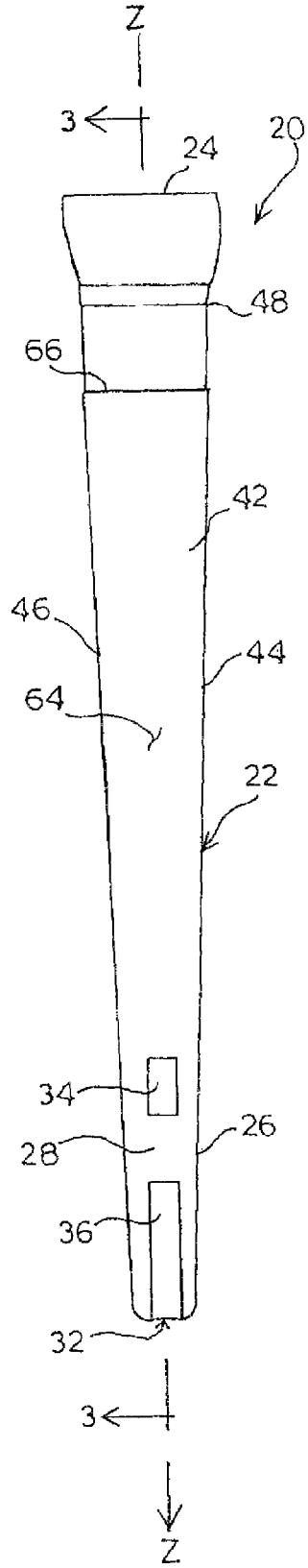
FIG. 2 is side elevation illustration of the submerged entry nozzle embodiment of FIG. 1.

FIG. 2 is a sidewall elevation of the SEN 20. The narrower dimension of the SEN 20 is shown in this Figure and is referred to as the SEN side wall 42. Opposite side wall 43 is shown in FIG. 1. The widest dimensions of the SEN 20 are associated with that portion of the SEN that is here referred to as the front wall 44 (FIG. 1) and back wall 46 (FIG. 1). The front and back walls 44, 46 of the SEN converge as shown in FIG. 2 in a substantially linear tapered manner, beginning at a point 48 tangent to the circumference of the inlet 24, and continuing to the bottom portion 32 of the SEN. The taper provides the SEN with a narrowed depth dimensions useful for CSP operations.

Figure 3:
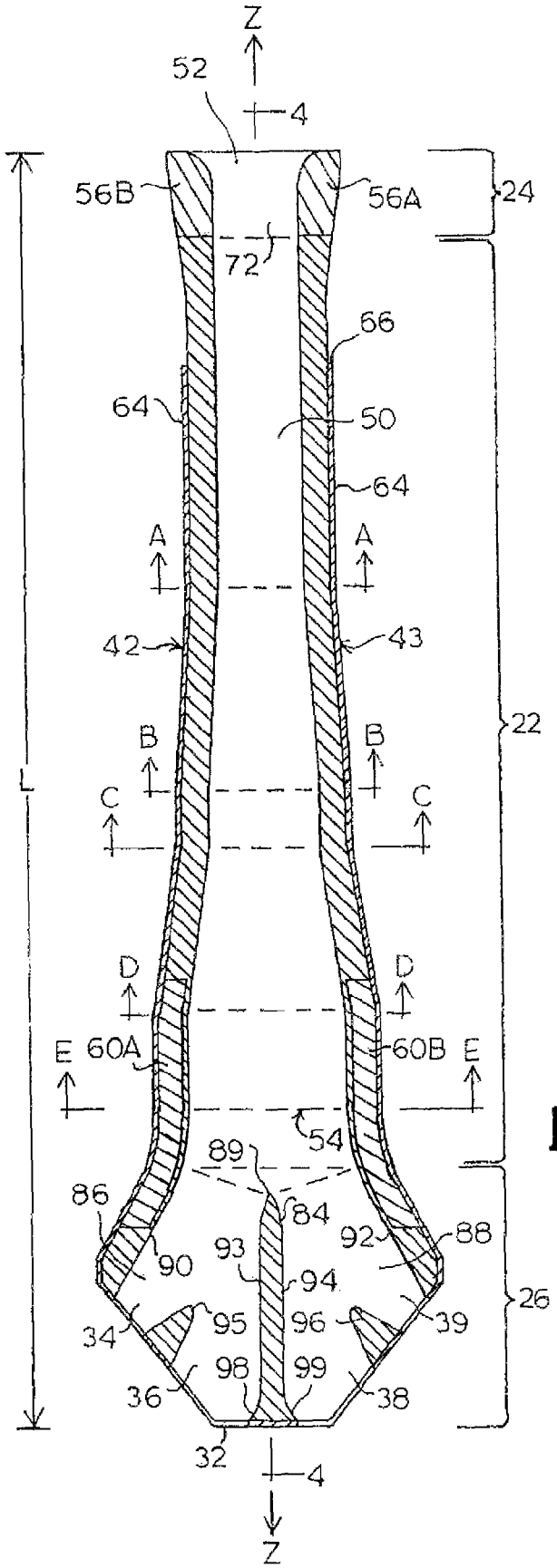
FIG. 3 is an axial section of the submerged entry nozzle of FIG. 1, taken along the section line 3-3 of FIG. 2.
Figure 4:
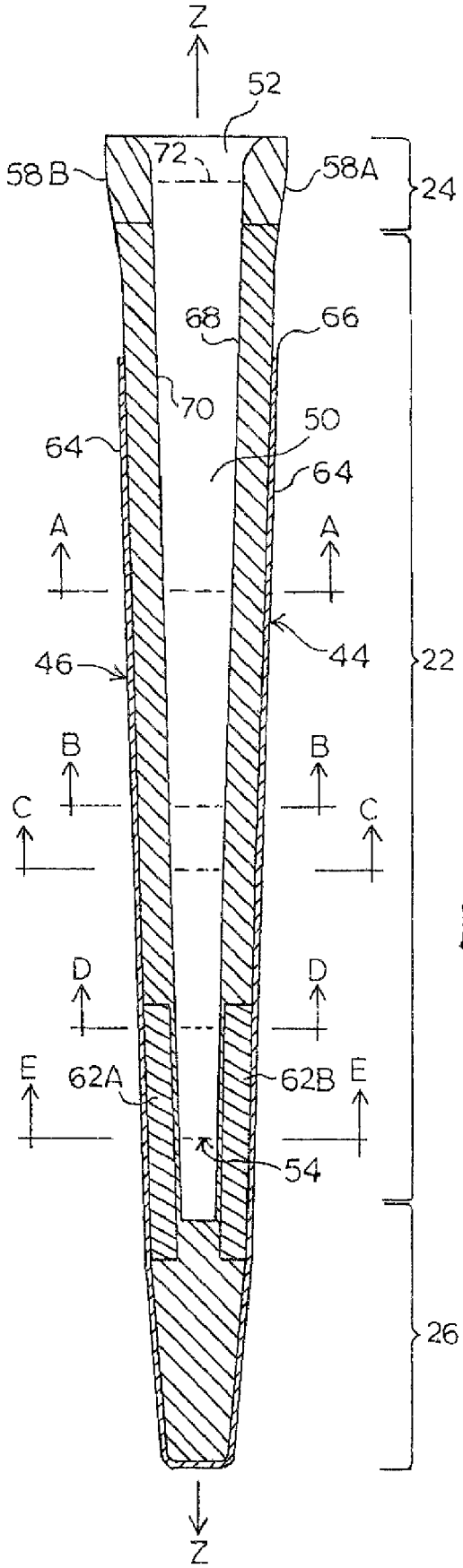
FIG. 4 is an axial section of the submerged entry nozzle of FIG. 1, taken along the section line 4-4 of FIG. 3.

FIG. 3, is a section of the SEN 20 taken along the line 3-3 of FIG. 2 that includes the back wall 46 of the SEN 20. FIG. 4 is a section of the SEN 20 taken along the line 4-4 of FIG. 3 that includes the side wall 43 of the SEN 20. The following description of the SEN structural and functional features refers to FIGS. 3 and 4.

While the SEN main body 22, inlet 24, and distribution zone 26 areas are shown as proximate to the areas that are bounded by the dashed lines associated with their reference numbers, these areas are shown in FIGS. 3 and 4 only for purpose of example and are not intended to limit or define the proportions of the body 22, inlet 24, and distribution zone 26. The main body 22 has a central bore 50 formed collectively by the front and back walls 44, 46 and side walls 42, 43. The central bore 50 provides a fluid flow path from the opening, or aperture 52, of the SEN inlet 24, to the entrance 54 of the distribution zone 26, which is located at the section line E-E.

The overall length (L) of the SEN, from the inlet 24 to its bottom 32, is determined by the tundish-to-mold operational distance for casting machine in which the SEN is to be used. A SEN for use in a CSP application may have an overall length, for example, about 1180 millimeter (mm) (or 46.5 inches). In the example shown in FIGS. 3 and 4, the main body 22 may be about 772 mm (30.4 inches), or 65%, the inlet 24 may be about 130 mm (5.12 inches) or 11%, and the distribution zone 26 (from its entrance 54 to the bottom 32 of the SEN) may be about 278 mm (11 inches), or 24%.

With the exception of the top throat area 56A, 56B (FIG. 3), and 58A, 58B (FIG. 4) of the inlet 24, and the segments 60A, 60B and 62A, 62B which bridge the main body and distribution zones, the SEN body structural material may comprise alumina graphite, which may contain, for example but not limited to, about 65% $Al_2O_3$, about 3% silica, and about 20% carbon, the balance being other anti-oxidants and fluxes. The throat areas 56A, 56B and 58A, 58B of the inlet 24 may be enhanced for wear purposes by adding magnesia graphite, which may contain, for example but not limited to, about 70% MgO, about 3% silica, and about 19% carbon, the balance being other anti-oxidants and fluxes. The top throat area designated as 56A, 56B in FIGS. 3 and 58A, 58B in FIG. 4 may be quarters of the same body.

The area of the SEN associated with the segment 60A, 60B (FIG. 3) and 62A, 62B (FIG. 4) may be positioned adjacent or along the slag line when installed in the mold. At least part of the alumina graphite of the main body adjacent to the slag line when installed in the mold may be replaced with zirconia graphite to enhance the wearability of the SEN and lessen the effects of surface erosion caused by the standing wave undulation of the slag surrounding the SEN. The zirconia graphite may contain, for example but not limited to, about 72% $ZrO_2$, about 6% silica, and about 15% carbon, the balance being other anti-oxidants and fluxes. The SEN segment area designated as 60A, 60B in FIGS. 3 and 62A, 62B in FIG. 4 may be quarters of the same body.

The SEN may be manufactured in an iso-static press in which the alumina graphite, magnesia graphite, and zirconia graphite mixed materials are placed in their designated SEN positions inside a mold and pressed together about the same time. The mold comprises: (i) a press tool that may be made of steel having exterior surfaces that establish the finished wall dimensions and geometry of the central bore 50, (ii) an outer elastomeric mold covering that encloses the press tool and defines the SEN exterior geometry; (iii) filling tools that permit placement of the alumina graphite, magnesia graphite, and zirconia graphite mixed materials in their relative SEN body positions inside the cavity created between the press tool and the outer elastomeric mold; and (iv) upper and lower closures that seal the press tool, mixed materials and the elastomeric outer mold.

The filled and sealed outer mold is then pressed inside the iso-static press, which may provide substantially omni-directional forces to the elastomeric outside mold to compact the materials at pressures up to or above 4000 pounds per square inch to provide a substantially homogeneous structure. The tooling is then disassembled by removing the top and bottom closures, the outer elastomeric mold, and the inner steel press tool leaving a pressed SEN product including the three pressed materials. The product is then cured in an oven, after which it is fired in a kiln to produce the carbo ceramic bond in the product. The outside surface is then machined to provide the final outside geometry of the SEN.

Following the outside surface machining the SEN body may be coated with various materials that protect the alumina graphite, zirconia graphite and magnesia graphite from oxidation when the SEN is subjected to the preheat process performed by the steel mill or other end user prior to SEN installation in the casting machine. The preheat step may include, for example, a 90 minute period at 1100 degrees Celsius, and is intended to prevent thermal shock of the SEN by the liquid steel when placed in use. These coatings are known glazes that maintain the material integrity of the SEN through the preheating process.

A commercially available ceramic fiber wrap 64 (FIGS. 1 and 2) may be added to the SEN. The wrap 64 may cover the distribution zone and main body and extend the length of the SEN to a point 66 short of the inlet 24. The wrap may allow the SEN to retain much of the preheat process temperature during the time it takes to install it in the caster, which may be up to 4 minutes or more. The wrap may allow the SEN to retain enough heat to withstand the thermal stresses induced when the 1560 degrees Celsius liquid steel begins flowing through it when the stopper rod or slide-gate is opened. The ceramic fiber wrap may be about four (4) millimeters thick or greater.

In an embodiment shown in FIGS. 3 and 4, the length of the central bore 50 from the inlet 24 to the entrance 54 of the distribution zone may be, for example, about 942 mm, and along this length the bore geometry transitions from substantially circular geometry adjacent the inlet 24 to a substantially rectangular geometry at the entrance 54 to the distribution zone 26. The substantially circular geometry adjacent the inlet may include shapes that are circular, oval, elliptical, and other arcuate forms. The term rectangular as used herein means shapes including rectangles, rhombi, and other polygonal and quadrilateral shapes, including regular and rounded forms thereof. Within its length the bore is provided with a variable geometry for varying the flow velocity of the liquid steel in sections along the flow path to change the steel flow rate within the SEN in a manner that accommodates flow changes from the tundish and provides the distribution zone with a stable column of liquid steel. This in turn may allow for a more laminar and near laminar flow of steel from the outlet ports 34, 36, 38, 39 and in any event inhibits turbulence within the casting mold.

These changes in flow velocity are accomplished through changes in the cross sectional area along sections of the bore. Since the front wall and back wall may converge over the length L of the SEN at a continual rate, they provide a convergence or compression of the steel flow, which in turn provides a steady increase in flow velocity. Here, the word "compression" as it relates to the flow of steel does not mean compression of the steel itself; instead, it means a constriction or reduction of the cross sectional area of the bore through which the steel flows in a nozzle. To counter the velocity increase, the side walls may diverge sufficiently in certain sections of the bore flow path to overcome the flow compression effects of the taper to allow the steel flow to diverge and to decrease in velocity. This axial arrangement of alternating convergent and divergent zone sections in the bore flow path provides an averaging of the flow, which reduces flow disruptions from the tundish that may occur at the initiation of flow with opening of the stopper rod or slide-gate.

As shown in FIG. 4, the opposing front and back wall may converge in a continuous taper from the substantially circular geometry adjacent the inlet 24 to the distribution zone 26. Alternately or in addition, the opposing side walls may be altered incrementally, or in zones, along the bore to provide sectional geometries that transition from the substantially circular geometry adjacent the inlet to the substantially rectangular geometry at the distribution zone.

Figure 5:
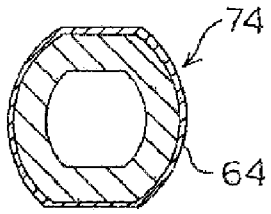
FIG. 5 is a cross section of the submerged entry nozzle of FIG. 1, taken along the section line A-A of FIG. 3.

In FIG. 4 the inner surfaces 68, 70 of the front wall 44 and back wall 46 begin their taper at the surface tangent 72 to the inlet aperture 52. The sectional geometries in the flow section from the tangent 72 to the cross section A-A begin with the diameter of the aperture 52 and due to the taper of the front and back wall inner surfaces 68, 70 decrease in cross sectional area (CSA) until at Section A-A the area appears as shown in FIG. 5 with CSA 74. The section provides compression of the flow and an increased flow velocity. For example, the length of this flow section may be about 407 mm, or 43% of the bore length. The aperture 52 may have about an 81 mm diameter and about a 5152 $mm^2$ area while Section A-A (74, FIG. 5), due to convergence of the front and back wall inner surfaces 68, 70 may have a bore cross sectional area of about 4796 $mm^2$; in this example a 7% reduction in CSA with a consequent increase in flow velocity.

Figure 6:
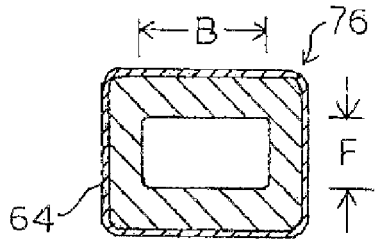
FIG. 6 is a cross section of the submerged entry nozzle of FIG. 1, taken along the section line taken along the line B-B of FIG. 3.
Figure 7:
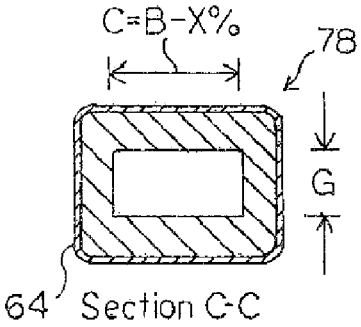
FIG. 7 is a cross section of the submerged entry nozzle of FIG. 1, taken along the section line taken along the line C-C of FIG. 3.
Figure 8:
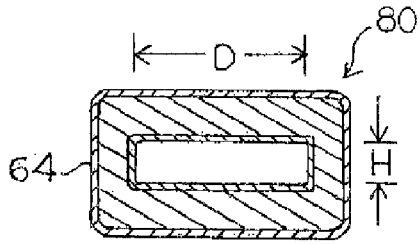
FIG. 8 is a cross section of the submerged entry nozzle of FIG. 1, taken along the section line taken along the line D-D of FIG. 3.
Figure 9:
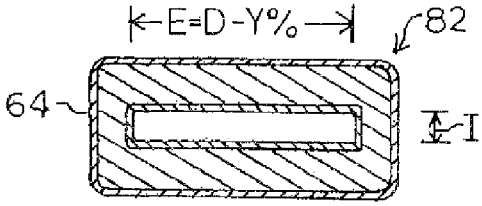
FIG. 9 is a cross section of the submerged entry nozzle of FIG. 1, taken along the section line taken along the line E-E of FIG. 3.

The bore flow path interval between Section A-A and B-B in FIGS. 3 and 4 may be about 193 mm, or about 20% of the length of the bore flow path, and provide a flow divergence. This may be the first point of transition from the circular inlet section diameter to the rectangular distribution zone, which is the submerged portion of the SEN. At Section B-B the SEN side walls 42, 43 may have completed their circular-to-rectangular transition and the Section B-B profile 76, FIG. 6, is shown as substantially rectangular. The radiused corners reduce stresses between the corners of the section of the nozzle and aid smooth transition of the steel stream inside the nozzle at the outsides of the inside bore. In FIG. 6, the front and back wall inner surface spacing is F and the side wall spacing is B. For example, the Section B-B area may be about 5292 $mm^2$, which in this example makes a 10% increase in CSA over Section A-A with a consequent decrease in flow velocity.

The flow path interval from Section B-B to C-C in FIGS. 3 and 4 may be approximately 50 mm long, or 5% of the length of the bore flow path, providing a second compression zone. Section C-C is shown at 78, FIG. 7 with a front to back wall inner surface spacing as G (where $G<F$) and the side wall spacing as $C=B-X$ %. X may be greater than or equal to 5% and less than or equal to 10% ($5\% \leqq X \leqq 10\%$). Alternately, X may be greater than or equal to about 3% and less than or equal to about 10% ($3\% \leqq X \leqq 10\%$). For example, the area of Section C-C may be about 4977 $mm^2$, or about 6% less than Section B-B, and yield an increased flow velocity. Alternately, the Section C-C area may be between about 4763 $mm^2$ and about 5133 $mm^2$, or between about 3% and 10% less than the cross sectional area of Section B-B.

For example, the flow path interval from Section C-C to D-D in FIGS. 3 and 4 may be about 156 mm long, or 16% of the bore length providing a second diverging flow interval. Section D-D is shown at 80, FIG. 8 with the front and back wall inner surface spacing as H (where $H<G$) and the side wall spacing as D. The area of Section D-D may be, for example, about 5934 $mm^2$, which in this example makes a 19% increase over that of Section C-C with a consequent decrease in flow velocity.

The interval of the bore flow path from Section D-D to E-E may be about 136 mm long, or about 14% of the length of the bore flow path. Section E-E is shown at 82, FIG. 9, with the front and back wall inner surface spacing as I (where $I<H$) and the side wall spacing as $E=D-Y$ %. Y may be greater than or equal to 12% and less than or equal to 18% ($12\% \leqq Y \leqq 18\%$). The area of Section E-E in this range may be about 5224 $mm^2$, about a 12% decrease over that of Section D-D with a consequent increase in flow velocity. Alternately, Y may be greater than or equal to about 3% and less than or equal to about 10% ($3\% \leqq X \leqq 10\%$). Correspondingly, the Section E-E area may be between about 5341 $mm^2$ and about 5756 $mm^2$, or between about 3% and 10% less than the cross sectional area of Section D-D. For either range, this creates the concentrated steel stream inside the compression zone immediately above the distribution zone 26, providing a supply that is stable prior to entering the flow-dividing portion of the nozzle. The acceleration of the liquid stream at the Section E-E exit allows that the desired angular trajectory of the steel stream discharged from the outlet ports to the mold will be achieved. Also, the steel flow above the compression zone is oriented to fill the bore as the steel attempts entry into the compression zone, thereby improving the flow conditions by reducing dead zones and encouraging laminar flow.

The compression zone from the inlet aperture 52 to Section A-A (referred to here as the "initial compression zone") is within the circular to rectangular transition area of the SEN. While it may be possible to alter the geometry to affect its compression characteristics, we have found changes in the initial compression zone having less effect than changes to Section B-B to C-C ("Upper Compression Zone") and Section D-D to E-E ("Lower Compression Zone"). The Upper and Lower Compression Zones have practical application in programming the flow characteristics, because they are more easily altered and have higher gain characteristics as they are deeper within the narrowed taper profile where relatively small changes in sidewall to sidewall divergence provide a large velocity change.

The cross sectional area at the beginning of each of the two or more compression zones is larger at the upper most point, the entry point of the compression zone, than the lower exit point of the compression zone. This creates the restriction of the steel stream inside the compression zone and also accelerates the stream velocity into the next flow path zone within the internal geometry of the submerged entry nozzle. Due to the restriction caused by the smaller cross sectional area at the compression zones the volume of steel able to pass through is restricted and causes a positive steel pressure at the entry to the flow path zone that fills the complete cavity as the supply of steel enters the compression zone. This stabilizes the stream conditions by reducing dead zones and encouraging laminar flow through the compression zone and results in more consistent exit conditions from the flow path zones.

The alternating diffusion and compression zones, or flow path zones, deliver a concentrated flow of steel to the distribution zone 26, which in turn provides a compressed lateral stream distribution into the caster mold (including thin slab molds). This is in major part attributable to the compression zones that may be provided in two or more locations along the length of the bore flow path. These compression zones provide delivery of a concentrated flow of molten steel to the distribution zone 26.

Within the distribution zone, the primary column of steel flowing from the bore may be divided by flow divider 84 into two lateral flows. The distribution zone directs the lateral flows to associated lateral passages 86, 88, which house the SEN outlet ports. The flow divider may be provided with a leading edge 89 that has a radius of about 5 mm or less. This leading edge radius together with an about 150 mm radius of the outside walls 90, 92 of the lateral passages 86, 88 allows the individual lateral flows to maintain contact with vertical surfaces 93, 94 of the flow divider 84 and the outside walls while flowing through the passages. The radius of the outside walls 90, 92 of the lateral passages 86, 88 may be in a range of about 120 mm to about 400 mm. Alternately, the radius of the outside walls 90, 92 of the lateral passages 86, 88 may be in a range of about 150 mm to about 300 mm.

The passage 86 channels the received flow between the flow divider vertical surfaces 93 and outside passage wall 90 to outlet ports 34, 36, and passage 88 directs its flow between the flow divider surface 94 and outside passage wall 92 to outlet ports 38, 39. The divider vertical surfaces 93, 94 and the diverging passage walls 90, 92 increase the cross sectional area of their associated passages as they approach the outlet ports. This enables the outlet ports to perform two functions: (i) the deceleration of the steel flow in each of the lateral passages provides that the steel columns within the passages fill the cross sectional area of the passages leading to the outlet ports, and (ii) the further division of the secondary streams into upper lateral and lower lateral discharge flows by the baffles 95, 96.

The surface contours of the baffles 95, 96 may be customized to provide flow discharge angles for a given casting mold configuration or cast section shape. In some embodiments of the SEN, the baffles providing the upper lateral streams may have a discharge angle from outlet ports 34, 39 greater than 30 degrees. As shown in FIG. 3, the flow divider 84 is provided with an increasing width base section 98, 99 that provides angular displacement of the secondary steel flows to suit the casting mold flow requirements of particular embodiments. The about 5 mm or smaller commencing radius of the leading edge 89 of the flow divider 84 permits the division of the primary flow from the bore flow path with low turbulence, which enables the secondary lateral flows to remain in contact with the divider vertical surfaces 93, 94.

The principal of dividing the stream into two secondary lateral columns provides improved control of the steel exiting the ports when combined by the stream concentration, which has occurred in the compression zones.

Figure 10:
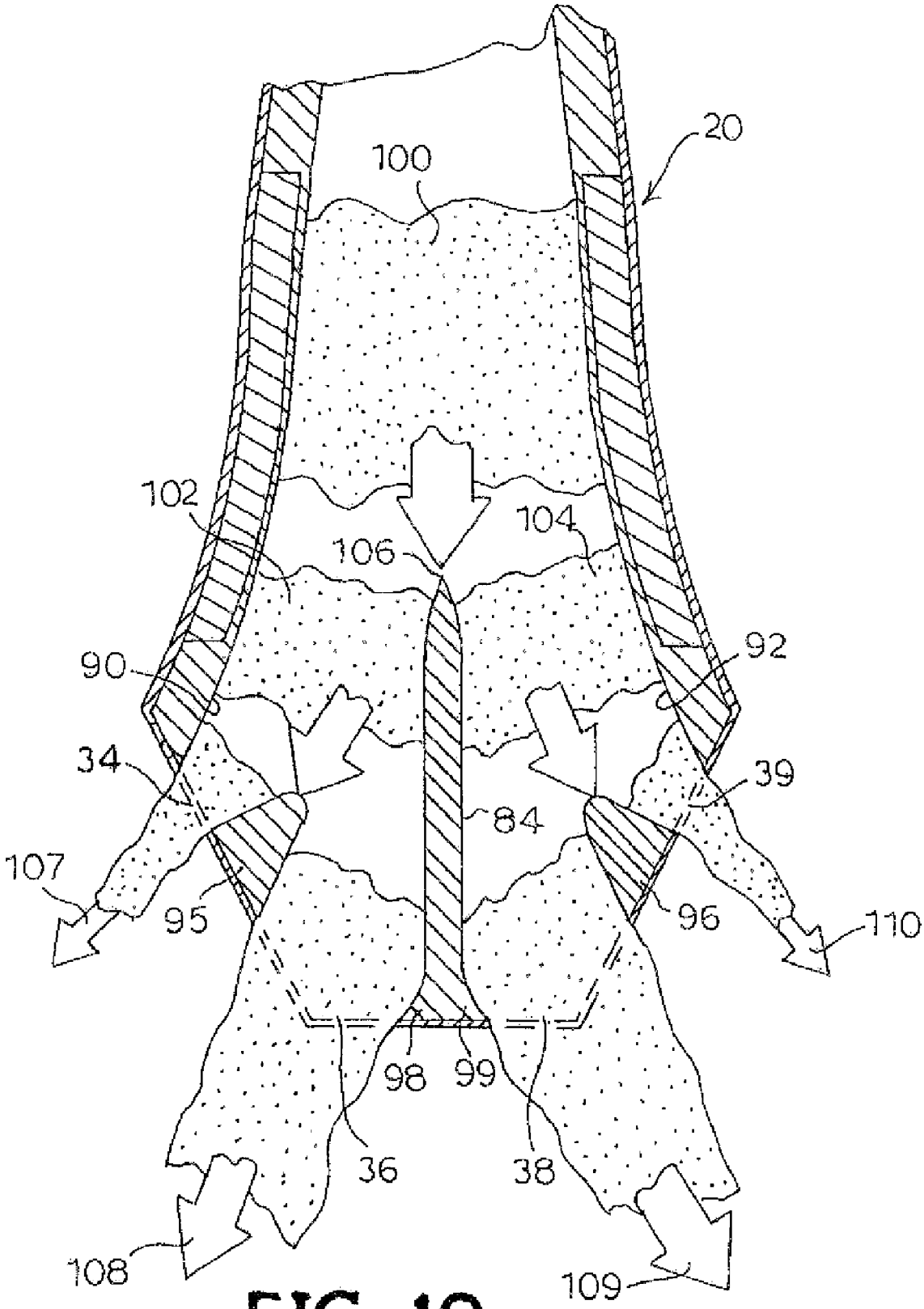
FIG. 10 is an illustration of an operating characteristic of the submerged entry nozzle embodied in FIGS. 1-9.

FIG. 10 is a figurative illustration of the flow division performed by the distribution zone. The primary laminar and near laminar flow of liquid steel 100 from the bore enters the distribution zone and is first divided into two secondary flows 102, 104 by the flow divider 84. The divider has a fine tip 106 and relatively narrow width so as to divide the primary flow into the secondary flows with lessened turbulence allowing the distribution zone to maintain closer to laminar flow in the secondary flows 102, 104. This in turn allows the secondary flows to be divided by the baffles 95, 96 into four outlet port discharge flows 107-110; each of which are more laminar and inhibiting turbulence within the casting mold.

Figure 11:
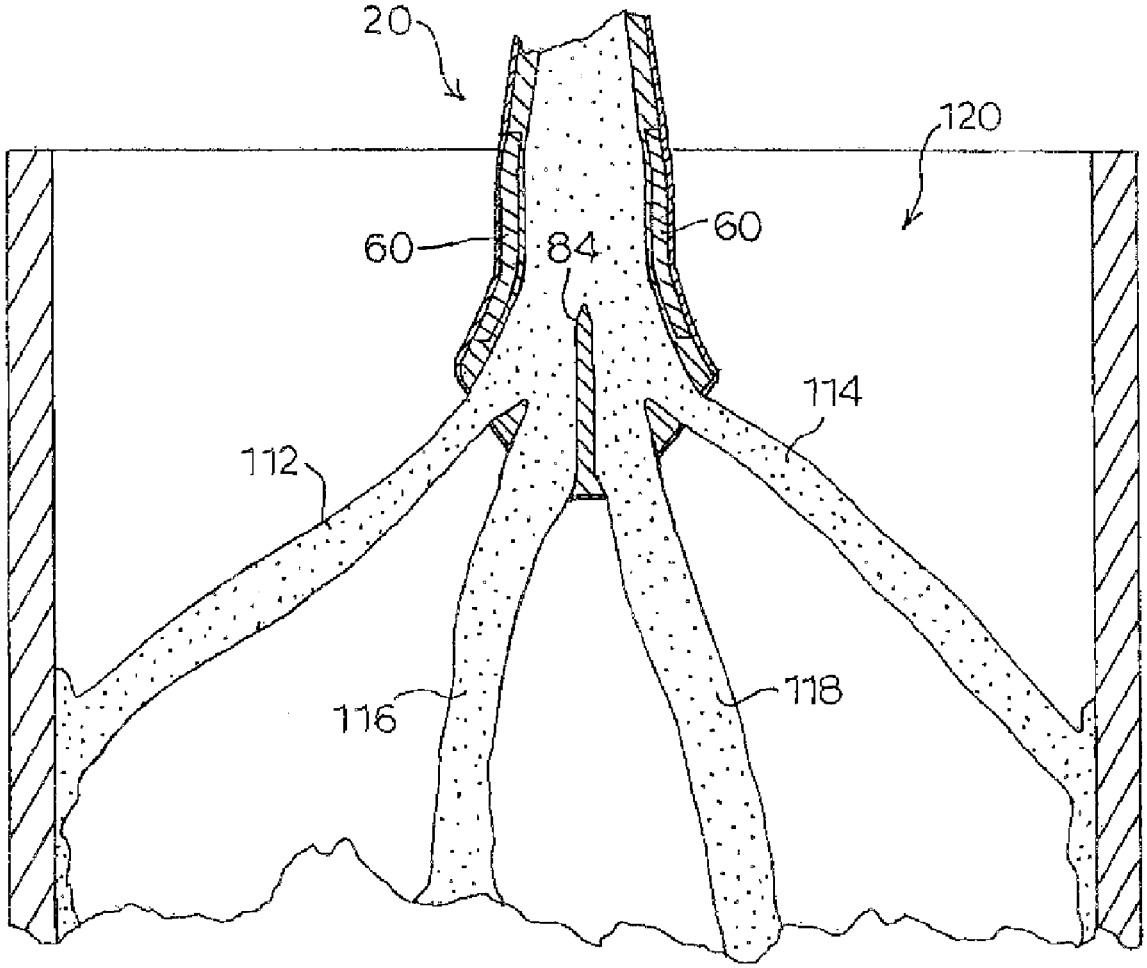
FIG. 11 is an illustration of another operating characteristic of the submerged entry nozzle embodied in FIGS. 1-9.
Figure 12:
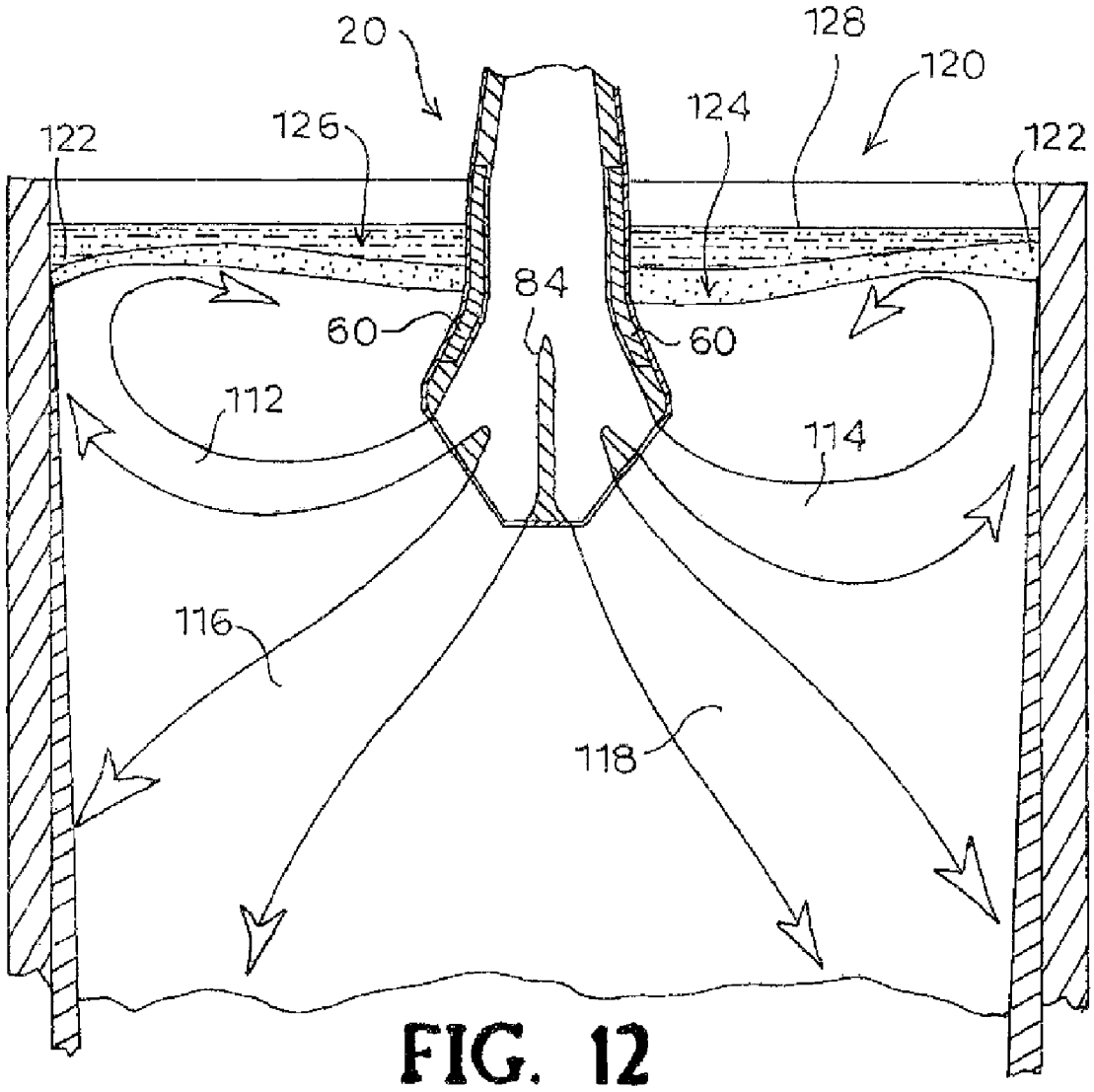
FIG. 12 is an illustration of still another operating characteristic of the submerged entry nozzle embodied in FIGS. 1-9.

FIG. 11 illustrates the trajectory of the discharged upper lateral steel streams 112, 114 and lower lateral streams 116, 118 from SEN 20 into an empty mold 120, as occurs upon the initiation of the casting process. The upper lateral streams are shown to have a greater than 30 degree angular displacement. FIG. 12 shows the double roll flow pattern of the upper and lower lateral steel flows 112-118 from SEN 20 in a mold liquid steel bath as occurs in the casting process steady state operation. The upper lateral steel flows 112, 114 move upward and curl along the under surface of the meniscus 122 and back toward the nozzle. The upper lateral flows heat the meniscus 122 to maintain its temperature at a level sufficient to melt the mold powder 124 and provide proper lubrication to the casting. They also produce a reduced amplitude standing wave profile with the mold powder slag layer 126 that is slightly thinner at the meniscus 122 than at the slag line 128 along the SEN 20.

As known in the art, the slag layer may erode the surface of the SEN that it surrounds. This erosion is one of the useful-life determinants of the SEN. Adding the zirconia graphite layers in the circumferential band (60A, 60B, 62A, 62B, FIGS. 3, 4, 12) of the SEN helps in extending the SEN wear life. In the present invention, however, the taper provided to the SEN, which begins at a point tangent to the circular inlet, allows the bore flow path to achieve its terminal sectional geometry at an earlier position of the overall length L of the SEN. This means that the internal geometry of the present SEN is narrower in the area of the zirconia graphite bands than prior art SENs. This allows the present SEN to have a greater wall thickness in this area, thereby extending the useful life of the SEN.

Figure 14:
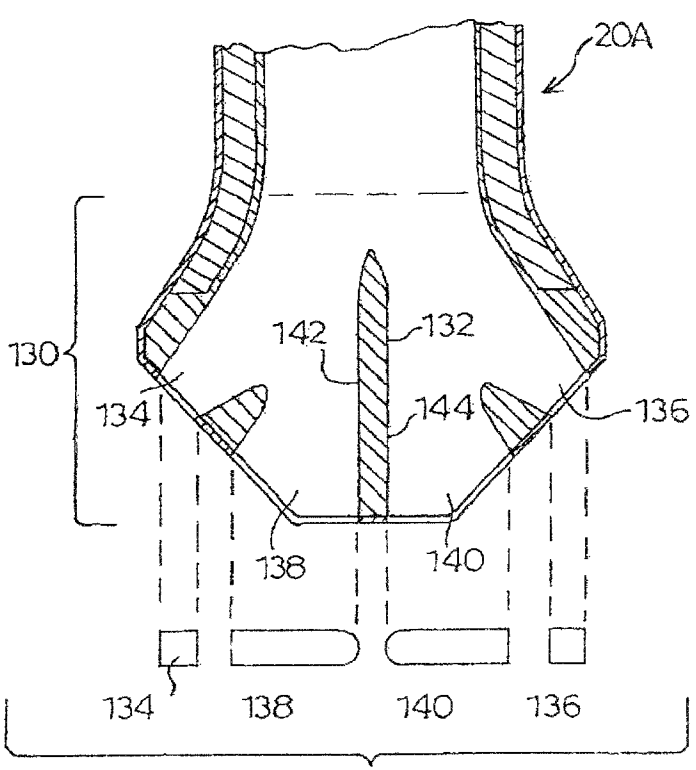
FIG. 14 is a figurative illustration, partially in section, of a physical detail of an alternative embodiment of a submerged entry nozzle embodiment to that shown in FIG. 3 and FIG. 13.
Figure 13:
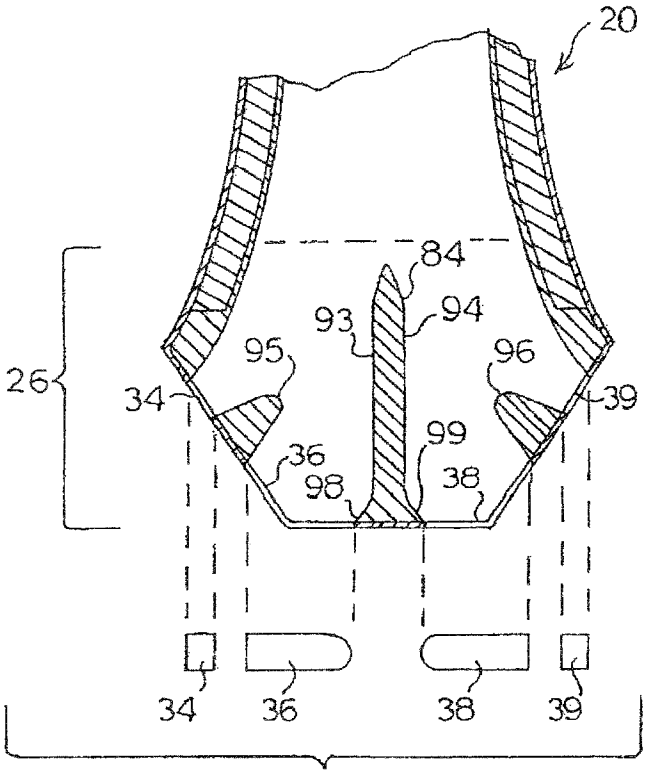
FIG. 13 is a figurative illustration, partially in section, of a further physical detail of the submerged entry nozzle embodied in FIGS. 1-9.

FIG. 13 shows a partial section of the SEN for the purpose of illustrating the configuration that has been described hereinabove for the distribution zone 26. FIG. 14 is a partial section of an alternative embodiment SEN 20A having a distribution zone 130 comprising a flow divider 132 with a reduced or eliminated base section as shown as 98, 99 in FIGS. 3 and 13. While the other elements of the two distribution zones are the same, the outlet ports of the distribution zone 130 are numbered differently to distinguish them for comparative purposes.

The distribution zone 130 may have the same lateral passage geometries and baffle configurations, and provide upper lateral outlet ports 134, 136 that are similar to the upper lateral outlet ports 34, 39 of the distribution zone 26. However, reducing the divider base increases the area of the lower lateral outlet ports 138, 140 by up to 15% or more over that of the lower lateral outlet ports 36, 38 of the distribution zone 26, and the straight vertical surfaces 142, 144 of the flow divider 132 provide for an improved volume of flow from the lower lateral outlet ports 138, 140 being discharged directly downward. This may be a discharge flow characteristic for more narrow cast products, such as those in the 50 mm to 100 mm band of thin cast slabs.

Although the invention has been shown and described with respect to a best mode embodiment thereof, it should be understood by those skilled in the art that various changes, omissions, and additions may be made to the form and detail of the disclosed embodiment without departing from the spirit and scope of the invention, as recited in the following claims.

What is claimed is:

1. A submerged entry nozzle (SEN) for use in a casting machine to conduct molten steel from a tundish to a mold, comprising:

a housing having an inlet capable of receiving an incoming flow of molten steel from the tundish;

a distribution zone capable of delivering the molten steel to the mold, the distribution zone comprising a flow divider dividing the flow of molten steel into secondary flows through first and second lateral passages; and a main body having a bore capable of conducting molten steel therethrough from said inlet to said distribution zone, said bore having sectional geometries capable of alternately compressing and decompressing the molten steel flow in flow path zones to alternately increase and decrease the steel flow velocity with at least two flow path zones capable of compressing the molten steel flow, while increasing the cross-sectional area and providing smooth transitions to deliver the molten steel from said distribution zone into the mold with flow turbulence inhibited.

2. The submerged entry nozzle (SEN) as claimed in claim 1, wherein said lateral passages having baffles adjacent passage outlets dividing the molten steel secondary flows into four molten steel discharge flows delivering the molten steel to the mold in divergent directions.

3. The submerged entry nozzle (SEN) as claimed in claim 2, wherein said housing transitions along the sectional geometries of said main body from a substantially circular geometry to a substantially rectangular geometry having opposing side walls and opposing front and back walls at said distribution zone, said opposing front and back walls converging from said substantially circular geometry to said distribution zone.

4. The submerged entry nozzle (SEN) as claimed in claim 3, wherein said opposing side walls transition from said substantially circular geometry to said substantially rectangular geometry at said distribution zone in an incremental manner.

5. The submerged entry nozzle (SEN) as claimed in claim 3, wherein said opposing side walls are altered incrementally along the bore to provide said sectional geometries.

6. The submerged entry nozzle (SEN) as claimed in claim 3, wherein said opposing front and back walls converge in a continuous linear taper from said substantially circular geometry to said distribution zone.

7. The submerged entry nozzle (SEN) as claimed in claim 3, wherein said sectional geometries include an upper compression zone and a lower compression zone, said upper compression zone providing from three percent to ten percent compression of the molten steel flowing therethrough and said lower compression zone providing from three percent to ten percent compression of the molten steel flowing therethrough.

8. The submerged entry nozzle (SEN) as claimed in claim 1, wherein said flow divider comprises a leading edge having a radius of curvature for dividing the molten steel primary flow into said lateral passages with lessened flow turbulence.

9. The submerged entry nozzle (SEN) as claimed in claim 8, wherein the radius of curvature of said flow divider leading edge is a maximum 5 mm radius.

10. The submerged entry nozzle (SEN) as claimed in claim 8, wherein said flow divider comprises a vertical section with opposite sides thereof forming surface contours directing molten steel flow through said lateral passages.

11. The submerged entry nozzle (SEN) as claimed in claim 8, wherein said flow divider comprises a vertical section with substantially straight sides directing two molten steel discharge flows substantially vertically downward.

12. The submerged entry nozzle (SEN) as claimed in claim 1, wherein at least part of the main body adjacent to a slag line when installed in the mold comprises zirconia graphite.

13. The submerged entry nozzle (SEN) as claimed in claim 1, wherein said distribution zone comprises said first and second lateral passages of increasing cross sectional area.

14. A method of continuously casting steel slabs comprising the steps of:

assembling a casting mold capable of continuous casting of melt slabs;

assembling a tundish above the casting mold capable of containing molten steel to be cast and having an outlet capable of discharging the molten steel for the tundish; and introducing molten steel into the casting mold from the outlet of the tundish through a submerged entry nozzle (SEN) comprising a housing having an inlet capable of receiving an incoming flow of molten steel from the tundish, a distribution zone capable of delivering the molten steel to the mold, the distribution zone comprising a flow divider dividing the flow of molten steel into secondary flows through first and second lateral passages, and a main body having a bore capable of conducting molten steel therethrough from said inlet to said distribution zone, said bore having sectional geometries capable of alternately compressing and decompressing the molten steel flow in flow path zones to alternately increase and decrease the steel flow velocity with at least two flow path zones capable of compressing the molten steel flow, while increasing the cross-sectional area and providing smooth transitions to deliver the molten steel from said distribution zone into the mold with flow turbulence inhibited.

15. The method of continuously casting steel slabs as claimed in claim 14 wherein the submerged entry nozzle (SEN) has said distribution zone comprising said lateral passages having baffles adjacent passage outlets dividing a molten steel primary flow into four molten steel secondary flows delivering the molten steel to the mold in divergent directions.

16. The method of continuously casting steel slabs as claimed in claim 15 wherein the submerged entry nozzle (SEN) has said housing transition along the sectional geometries of said main body from a substantially circular geometry adjacent said inlet, to a substantially rectangular geometry having opposing side walls and opposing front and back walls at said distribution zone, said opposing front and back walls converging from said substantially circular geometry to said distribution zone.

17. The method of continuously casting steel slabs as claimed in claim 16 wherein the submerged entry nozzle (SEN) has said opposing side walls transition from said substantially circular geometry to said substantially rectangular geometry at said distribution zone in an incremental manner.

18. The method of continuously casting steel slabs as claimed in claim 16 wherein the submerged entry nozzle (SEN) has said opposing side walls altered incrementally along the bore to provide said sectional geometries.

19. The method of continuously casting steel slabs as claimed in claim 16 wherein the submerged entry nozzle (SEN) has said opposing front and back walls converge in a continuous linear taper from said substantially circular geometry to said distribution zone.

20. The method of continuously casting steel slabs as claimed in claim 16, wherein the submerged entry nozzle (SEN) has said sectional geometries comprising an upper compression zone and a lower compression zone, said upper compression zone providing from three percent to ten percent compression of the molten steel flowing therethrough and said lower compression zone providing from three percent to ten percent compression of the molten steel flowing therethrough.

21. The method of continuously casting steel slabs as claimed in claim 14 wherein the submerged entry nozzle (SEN) has said flow divider comprising a leading edge having a radius of curvature for dividing the molten steel primary flow into said lateral passages with reduced flow turbulence.

22. The method of continuously casting steel slabs as claimed in claim 21 wherein the submerged entry nozzle (SEN) has the radius of curvature of said flow divider leading edge being a maximum 5 mm radius.

23. The method of continuously casting steel slabs as claimed in claim 21 wherein the submerged entry nozzle (SEN) has a flow divider vertical section with opposite sides thereof forming surface contours directing molten steel flow through said lateral passages.

24. The method of continuously casting steel slabs as claimed in claim 21 wherein the submerged entry nozzle (SEN) has said flow divider comprising a vertical section with substantially straight sides directing two molten steel discharge flows substantially vertically downward.

25. The method of continuously casting steel slabs as claimed in claim 14 wherein the submerged entry nozzle (SEN) has at least part of the main body adjacent to a slag line when installed in the mold comprising zirconia graphite.

26. The method of continuously casting steel slabs as claimed in claim 14 wherein the submerged entry nozzle (SEN) has said distribution zone comprising said first and second lateral passages of increasing cross sectional area.

27. A continuous slab caster comprising:

a casting mold capable of continuous casting of melt slabs;

a tundish positioned above the casting mold capable of containing molten steel to be cast and having an outlet capable of discharging the molten steel from the tundish; and a submerged entry nozzle (SEN) capable of introducing molten steel into the casting mold from the outlet of the tundish, and comprising a housing having an inlet capable of receiving an incoming flow of molten steel from the tundish, a distribution zone capable of delivering the molten steel to the mold, the distribution zone comprising a flow divider dividing the flow of molten steel into secondary flows through first and second lateral passages, and a main body having a bore capable of conducting molten steel therethrough from said inlet to said distribution zone, said bore having sectional geometries capable of alternately compressing and decompressing the molten steel flow in flow path zones to alternately increase and decrease the steel flow velocity with at least two flow path zones capable of compressing the molten steel flow, while increasing the cross-sectional area and providing smooth transitions to deliver the molten steel from said distribution zone into the mold with flow turbulence inhibited.

28. The continuous slab caster as claimed in claim 27 wherein the submerged entry nozzle (SEN) has said distribution zone comprising said lateral passages having baffles adjacent passage outlets dividing a molten steel primary flow into four molten steel secondary flows delivering the molten steel to the mold in divergent directions.

29. The continuous slab caster as claimed in claim 28 wherein the submerged entry nozzle (SEN) has said housing transition along the sectional geometries of said main body from a substantially circular geometry adjacent said inlet, to a substantially rectangular geometry having opposing side walls and opposing front and back walls at said distribution zone, said opposing front and back walls converging from said substantially circular geometry to said distribution zone.

30. The continuous slab caster as claimed in claim 29, wherein the submerged entry nozzle (SEN) has said opposing side walls transition from said substantially circular geometry to said substantially rectangular geometry at said distribution zone in an incremental manner.

31. The continuous slab caster as claimed in claim 29, wherein the submerged entry nozzle (SEN) has said opposing side walls altered incrementally along the bore to provide said sectional geometries.

32. The continuous slab caster as claimed in claim 29, wherein the submerged entry nozzle (SEN) has said opposing front and back walls converge in a continuous linear taper from said substantially circular geometry to said distribution zone.

33. The continuous slab caster as claimed in claim 29, wherein the submerged entry nozzle (SEN) has said sectional geometries comprising an upper compression zone and a lower compression zone, said upper compression zone providing from three percent to ten percent compression of the molten steel flowing therethrough and said lower compression zone providing from three percent to ten percent compression of the molten steel flowing therethrough.

34. The continuous slab caster as claimed in claim 27 wherein the submerged entry nozzle (SEN) has said flow divider comprising a leading edge having a radius of curvature for dividing the molten steel primary flow into said lateral passages with reduced flow turbulence.

35. The continuous slab caster as claimed in claim 34 wherein the submerged entry nozzle (SEN) has the radius of curvature of said flow divider leading edge being a maximum 5 mm radius.

36. The continuous slab caster as claimed in claim 34 wherein the submerged entry nozzle (SEN) has a flow divider vertical section with opposite sides thereof forming surface contours directing molten steel flow through said lateral passages.

37. The continuous slab caster as claimed in claim 34 wherein the submerged entry nozzle (SEN) has said flow divider comprising a vertical section with substantially straight sides directing two molten steel discharge flows substantially vertically downward.

38. The continuous slab caster as claimed in claim 27 wherein the submerged entry nozzle (SEN) has at least part of the main body adjacent to a slag line when installed in the mold comprising zirconia graphite.

39. The continuous slab caster as claimed in claim 27 wherein the submerged entry nozzle (SEN) has said distribution zone comprising said first and second lateral passages of increasing cross sectional area.

* * * * *